United States Patent [19]

Taylor

[11] 4,280,316

[45] Jul. 28, 1981

[54] BRIDLE BIT SUGAR CUBE HOLDER

[76] Inventor: John D. Taylor, R.R. 3 Box 16, Perryton, Tex. 79070

[21] Appl. No.: 104,591

[22] Filed: Dec. 17, 1979

[51] Int. Cl.[3] ..... B68B 1/06

[52] U.S. Cl. ..... 54/8

[58] Field of Search ..... 54/7, 8, 9; 119/129

[56] References Cited

U.S. PATENT DOCUMENTS

| | | | |
|---|---|---|---|
| 509,968 | 12/1893 | Swan | 54/8 X |
| 2,017,021 | 10/1935 | Tepper | 54/7 |
| 3,837,142 | 9/1974 | Hill | 54/8 X |
| 4,063,404 | 12/1977 | Taylor | 54/8 |

FOREIGN PATENT DOCUMENTS

| | | | |
|---|---|---|---|
| 2404007 | 8/1975 | Fed. Rep. of Germany | 54/8 |

*Primary Examiner*—Gene Mancene
*Assistant Examiner*—Robert P. Swiatek
*Attorney, Agent, or Firm*—Robert K. Rhea

[57] ABSTRACT

A sugar cube holding device formed with a riding horse bridle bit having a rigid mouthpiece provided with an inverted U-shaped curb and having a roller loosely journalled for rotation in opposing directions about the axis of the mouthpiece at the depending limit of the curb. A downwardly open hood is placed over the inverted U-shape curb and is rigidly secured thereto to form a downwardly open chamber within the confines of the curb. An opening is formed in the rearwardly disposed wall of the hood for admitting a cube of sugar.

1 Claim, 3 Drawing Figures

BRIDLE BIT SUGAR CUBE HOLDER

BACKGROUND OF THE INVENTION

1. Field of the Invention

The present invention relates to bridle bits for riding horses and more particularly to the mouthpiece of a bridle bit.

Riding horses generally do not readily accept the mouthpiece of the bridle bit particularly in cold weather when the metallic bit is cold. The temperature of the bit can be warmed to some extent by immersing the bit in water before placing the bit in the horse's mouth. However, some horses object to accepting the mouthpiece at any time. Most horses enjoy the taste of sugar, such as sugar cubes, after once having tasted it.

This invention provides a means for holding a cube of sugar within the confines of the bit curb to induce horses to readily accept the bit.

2. Background of the Prior Art

The most pertinent prior art is believed to be my U.S. Pat. No. 4,063,404 disclosing a bridle bit having an inverted U-shaped curb portion provided with a roller at the depending limit of the curb. A downwardly open hood encompasses the curb to form a chamber loosely supporting a sugar cube in combination with the roller. The wall of the hood is provided with a plug closed opening for loosely inserting the sugar cube. The device disclosed by this patent operates satisfactorily, however, there is a possibility that the plug may come out of the hood opening, as a result of frictional engagement with an animal's tongue and be ingested.

This invention is distinctive over this patent by omitting the plug closing the sugar cube admitting opening by forming a square opening in the hood wall disposed in diamond-shape position and dimensioned for closely receiving a sugar cube.

SUMMARY OF THE INVENTION

The invention employs a bridle bit having cheek plates rigidly interconnected in parallel spaced relation by a rod-like mouthpiece, the mouthpiece having an inverted U-shaped curb medially its ends and including a roller loosely journalled for angular rotation about the axis of the opposing straight end portions of the mouthpiece by the tongue of a horse. A downwardly open housing or hood is placed over the curb to form a downwardly open chamber within the confines of the curb. The rearwardly disposed wall of the hood is provided with a square opening dimensioned for close passage of a cube of sugar into the chamber. The roller supports the sugar cube within the chamber.

The principal object of the invention is to provide a bridle bit with means for holding a sugar cube as an inducement in training a horse to readily accept the bridle bit mouthpiece into his mouth and as an inducement for the horse to be easily caught in a corral or in the field by a person on foot.

DESCRIPTION OF THE PREFERRED EMBODIMENT

Figure 1:
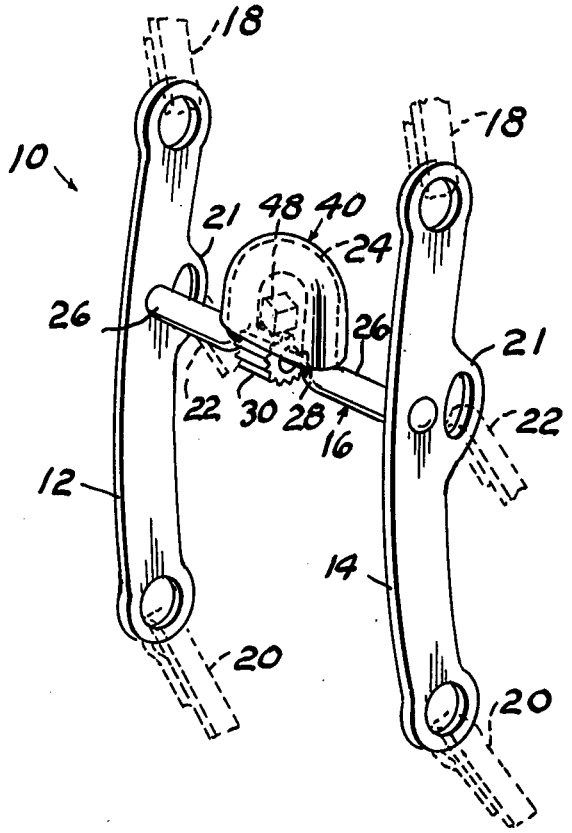
FIG. 1 is a perspective view of a bridle bit having the device installed thereon and illustrating, by dotted lines, the relative position of a sugar cube and bridle component fragments connected with the respective bridle cheek plate.
Figure 2:
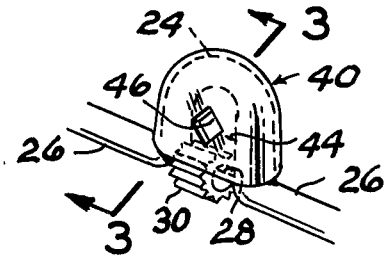
FIG. 2 is a fragmentary perspective view of the medial portion of the bridle bit mouthpiece from the opposite side of that shown by FIG. 1 illustrating the position of the hood opening; and, FIG. 3 is a vertical cross sectional view taken substantially along the line 3—3 of FIG. 2.

Like characters of reference designate like parts in those figures of the drawings in which they occur.

In the drawings:

The reference numeral 10 indicates a riding horse bridle bit comprising a pair of strap metal cheek plates 12 and 14 rigidly interconnected in spaced-apart relation by a normally horizontal rod-like mouthpiece 16. The respective ends of the cheek plates 12 and 14 are provided with rings or apertures for receiving bridle cheek straps 18 and reins 20, respectively. Intermediate their respective ends, the cheek plates 12 and 14 are provided with a rearwardly directed arcuate apertured projection 21 for receiving the respective ends of a chin strap 22. Intermediate its ends, the mouthpiece is formed to define an inverted substantially U-shaped curb 24 and oppositely disposed axially aligned mouthpiece rod end portions 26. Opposing surfaces of the mouthpiece inverted U-shaped curb 24 thus form forward and rearward surfaces parallel with the mouthpiece end portions 26 when the mouthpiece is placed in a horse's mouth, not shown. A pin or rod 28, having a diameter less than the mouthpiece end portions 26, extends coaxially between the end portions 26 in bridging relation with respect to the opening of the curb opposite its bight portion. A roller 30, having a serrated periphery, is freely journalled for angular rotation about the axis of the rod 28. The above description is conventional with riding horse bridle bits and is set forth to disclose structure with which the invention is to be used.

Figure 3:
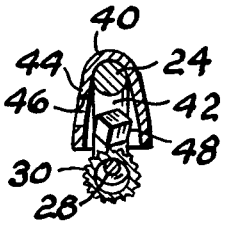

In carrying out the invention a downwardly open one piece hood 40, formed of thin wall metallic material, is disposed in overlying contiguous contacting relation with respect to the inverted U-shaped curb 24 thus forming a downwardly open chamber 42 (FIG. 3). The depending edge of the hood wall preferably lies in a substantially horizontal plane tangent to the periphery of the roller 30. The rearwardly disposed wall 44 of the hood is provided with a square opening 46 dimensioned to closely permit passage of a cube of sugar 48 into the chamber 42. The square opening 46 is characterized by diagonals through opposing corners being perpendicular and parallel with the axis of the bit end portions to substantially define a diamond-shaped opening. The roller 30, supported by the rod 28, prevents the sugar cube 48 from falling by gravity out of the chamber 42. The close fitting size of the opening 46, with respect to the sugar cube 48 and its orientation, in combination with the animal's tongue, normally precludes movement of the sugar cube from the chamber 42 through the opening 46.

OPERATION

In operation, prior to bridling a horse, the sugar cube 48 is placed within the chamber 42, as described hereinabove. With the mouthpiece 16 in place within the horse's mouth and a bridle strap on the horse's head, in a well known manner, the saliva in the horse's mouth begins dissolving the cube of sugar. Dissolving of the sugar cube is enhanced by the horse moving his tongue upwardly and downwardly against the roller 30 which revolves and by its serrations grind off portions of the sugar cube. Being fed a sugar cube each time the horse is bridled induces the horse to readily accept the mouthpiece into his mouth.

Obviously the invention is susceptible to changes or alterations without defeating its practicability. Therefore, I do not wish to be confined to the preferred embodiment shown in the drawings and described herein.

I claim:

1. In combination with a bridle bit having a rigid mouthpiece characterized by axially aligned normally horizontal opposing end portions and an inverted substantially U-shaped curb medially its length having a forward surface and a rearward surface and having a roller journalled for rotation about the axis of a pin horizontally bridging the spacing between the mouthpiece opposing end portions, the improvement comprising:

a hood overlying and secured to the inverted U-shaped curb of said mouthpiece and having a depending wall edge lying in a plane tangent with the upper limit of said roller for defining a downwardly open article receiving chamber within the U-shaped curb above said roller, the wall of said hood having a square opening, communicating with the chamber, dimensioned for close passage of a sugar cube, or the like, and characterized by being orientated to define a diamond shape.

* * * * *